United States Patent [19]

Amano et al.

[11] 4,437,832

[45] Mar. 20, 1984

[54] LAMP WICK EQUIPMENT FOR A COMBUSTION APPARATUS

[75] Inventors: Kazunori Amano, Niitsu; Youichi Sekiwaga, Kamo, both of Japan

[73] Assignee: Toshiba Heating Appliances Co., Ltd., Kamo, Japan

[21] Appl. No.: 422,197

[22] Filed: Sep. 23, 1982

[30] Foreign Application Priority Data

Oct. 15, 1981 [JP] Japan ..... 56-153261[U]

[51] Int. Cl.[3] ..... F23D 8/24

[52] U.S. Cl. ..... 431/304; 431/298; 431/302

[58] Field of Search ..... 431/304, 302, 303, 298, 431/305, 306, 307, 308, 309, 324, 120

[56] References Cited

U.S. PATENT DOCUMENTS

| | | | |
|---|---|---|---|
| Re. 2,128 | 12/1865 | Stuber et al. | 431/309 |
| 608,284 | 8/1898 | Gregory | 431/307 |
| 1,276,872 | 8/1918 | Chadwick | 431/308 |
| 3,388,961 | 6/1968 | Hebard | 431/307 |

FOREIGN PATENT DOCUMENTS

| | | | |
|---|---|---|---|
| 54-105333 | 8/1979 | Japan | 431/307 |
| 55-152319 | 11/1980 | Japan | 431/304 |

*Primary Examiner*—Samuel Scott
*Assistant Examiner*—Helen A. Odar
*Attorney, Agent, or Firm*—Oblon, Fisher, Spivak, McClelland & Maier

[57] ABSTRACT

The subject lamp wick equipment for a combustion apparatus comprises a cylindrical lamp wick, cylindrical lamp wick holder and cylindrical auxiliary lamp wick holder. The peripheral wall of the lamp wick is provided with openings. The auxiliary lamp wick holder is fitted around the lamp wick, and comprises engagement holes formed at that spots of the peripheral wall of the auxiliary lamp wick holder which face the openings. The cylindrical lamp wick holder is fitted around the cylindrical auxiliary lamp wick holder. The engagement pawls of the lamp wick holder are so elastically urged as to project thereinto. When the lamp wick is fitted into the auxiliary lamp wick holder, which in turn is fitted into the lamp wick holder, then the engagement pawls of the lamp wick holder project into the engagement holes of the auxiliary lamp wick holder and the openings of the lamp wick, thereby preventing the lengthwise relative movement of the lamp wick and lamp wick holder. The lamp wick is taken off the lamp wick holder by the lamp wick-removing device. This lamp wick-removing device comprises a pair of legs insertible between the lamp wick holder and auxiliary lamp wick holder. Said insertion of the paired legs causes the engagement pawls to be retracted from the engagement holes of the auxiliary lamp wick holder and the openings of the lamp wick, thereby assuring the disengagement of the lamp wick from the lamp wick holder.

8 Claims, 17 Drawing Figures

LAMP WICK EQUIPMENT FOR A COMBUSTION APPARATUS

BACKGROUND OF THE INVENTION

This invention relates to a lamp wick equipment for a combustion apparatus such as an oil heater.

A combustion apparatus such as an oil heater generally uses kerosene as fuel. The kerosene is stored in the fuel tank of a combustion apparatus. The upper end of a cylindrical lamp wick projects upward from a chafing dish set in the upper part of the combustion apparatus. The lower end of the lamp wick is dipped in the kerosene held in the fuel tank. When the upper end of the lamp wick projecting into the chafing dish member is ignited, the kerosene is sucked upward through the lamp wick, and combusted at the upper end of the lamp wick. The kerosene used by the consumer is sometimes accompanied with the drawback that it is contaminated by foreign oil due to unsatisfactory administration during circulation or storage in a tank or denatured during long storage. When the kerosene is used which is contaminated by foreign matter or denatured, then impurities such as tarry substances are deposited on the lamp wick, giving rise to the insufficient combustion of kerosene or obstructing the vertical movement of the lamp wick or presenting difficulties in extinguishing the combusting kerosene.

To remove the substances deposited on the used lamp wick, it is sometimes attempted to ignite the lamp wick while the fuel tank is emptied. This attempt is made because almost all impurities settle on that portion of the lamp wick which is exposed to the interior of the chafing dish member, and indeed is very effective to take off the impurities deposited on the upper end of the lamp wick. But said attempt is not effective for the removal of impurities settling on the proximity of the lower end of that portion of the lamp wick which is exposed to the interior of the chafing dish member. The reason is that said proximity is not sufficiently heated to take off impurities.

Therefore, it is necessary to release a lamp wick soiled by impurities from a combustion apparatus and replace said lamp wick by a fresh one. However, the conventional combustion apparatus presents difficulties in the exchange of lamp wicks. Namely, it has been necessary to carry out said exchange by dismantling the parts surrounding the lamp wick for removal. Said exchange involves very troublesome work.

SUMMARY OF THE INVENTION

It is accordingly an object of this invention to provide a lamp wick equipment for a combustion apparatus, which allows for the easy and efficient exchange of a lamp wick by improving a lamp wick-holding mechanism.

To attain the above-mentioned object, this invention provides a lamp wick equipment for a combustion apparatus which comprises:

- a cylindrical lamp wick whose peripheral wall is provided with at least one opening;
- a cylindrical auxiliary lamp wick holder which is fitted around the lamp wick and comprises an engagement hole formed at that spot on the peripheral wall of said auxiliary lamp wick holder which faces said opening of the lamp wick;
- a lamp wick holder which comprises a cylindrical body fitted around the auxiliary lamp wick holder, and an engagement pawl which is so elastically supported as to be normally advanced into the inside of said cylindrical body, to be retractable therefrom, and to project into the engagement hole of the auxiliary lamp wick holder fitted into said cylindrical body to effect engagement between the lamp wick and lamp wick holder; and
- a lamp wick-removing device comprising leg members which are inserted into a space defined between the auxiliary lamp wick holder and the lamp wick holder to retract the engagement pawl from the engagement hole, thereby disengaging the lamp wick from the lamp wick holder.

DETAILED DESCRIPTION OF THE PREFERRED EMBODIMENTS

Figure 1:
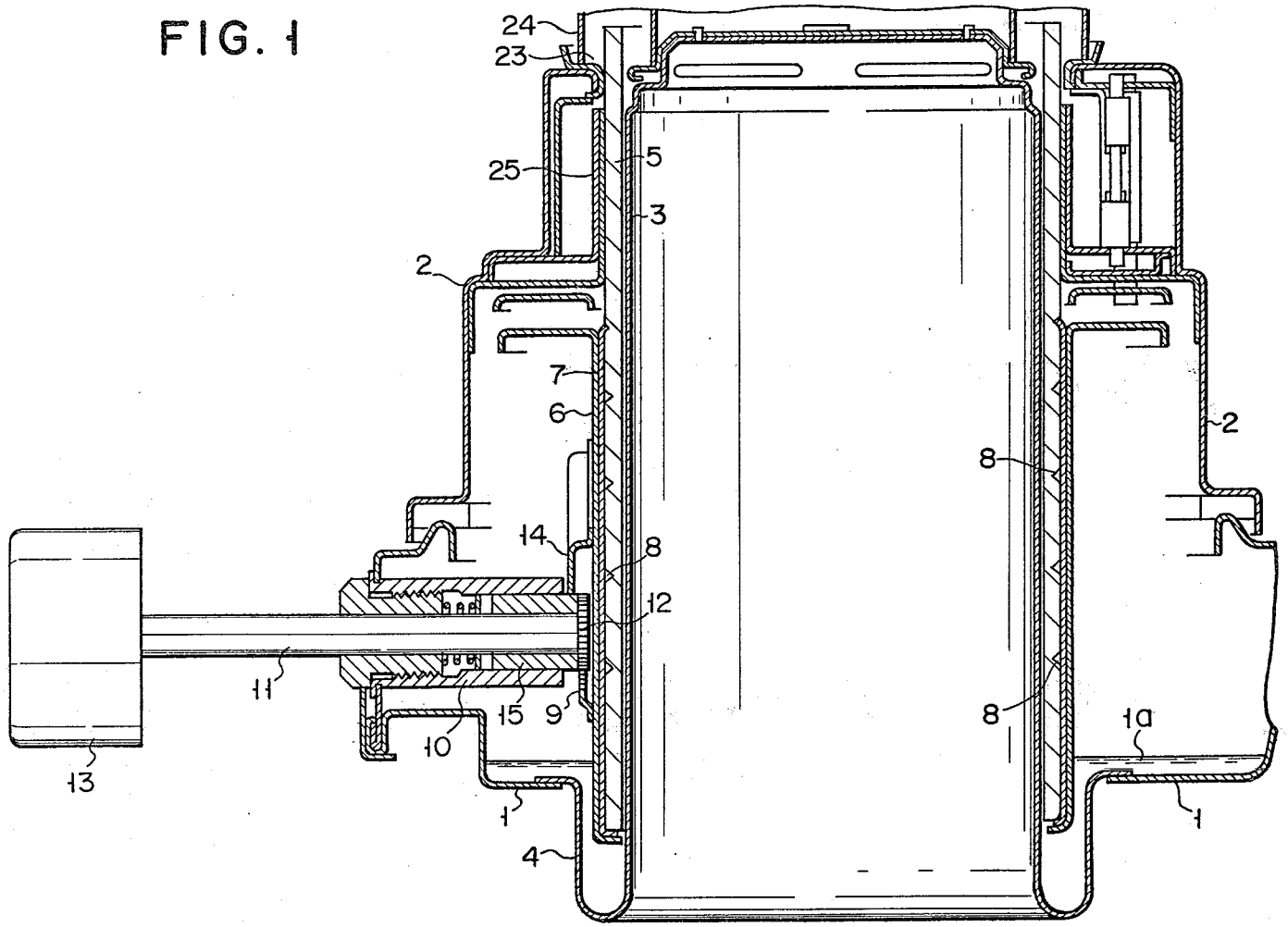
FIG. 1 is a fractional sectional view of a combustion apparatus fitted with a lamp wick equipment according to a first embodiment of this invention.

FIG. 1 schematically shows the peripheral section of a lamp wick equipment embodying this invention which is used with a combustion apparatus. A fuel tank 1 is mounted on a pedestal (not shown) of a combustion apparatus. The fuel tank 1 is supplied with a fuel 1*a* such as kerosene from, for example, a cartridge tank (not shown). The top and bottom plates are partly bored in the circular form. A cylindrical lamp wick guide 3 whose lower end portion constitutes an oil-storing groove 4 is fitted into the circular opening formed in the bottom plate of the fuel tank 1 in a vertically extending state. A burner basket 2 is fitted into the circular opening formed in the top plate of the fuel tank 1. A chafing dish member 23 is mounted at the upper end of the burner basket 2. A guide cylinder 25 is provided below the chafing dish member 23. A cylindrical lamp wick holder 6 is set below said guide cylinder 25. The guide cylinder 25 and lamp wick holder 6 have a slightly larger diameter than the cylindrical lamp wick guide 3 and are disposed in concentric relationship with the lamp wick guide 3. The lower end of the lamp wick holder 6 extends into the oil storing groove 4. A cylindrical lamp wick 5 is inserted in a gap between the lamp wick guide 3 on one hand, and the guide cylinder 25 and lamp wick holder 6 on the other. The lamp wick 5 is surrounded by the lamp wick guide 3. The lower half portion of the lamp wick 5 is engaged with an auxiliary lamp wick holder 7. When a holding pawl 8 mounted on the inner peripheral wall of the auxiliary lamp wick holder 7 is forced into the outer peripheral wall of the lamp wick 5, then said lamp wick 5 and auxiliary lamp wick holder 6 are engaged with each other.

A cylindrical combustion unit 24 is mounted on the chafing dish member 23. The upper portion of the lamp wick 5 slightly extends into the chafing dish member 23 to be positioned between the outer and inner cylinders of said cylindrical combustion unit 24. The lateral wall of the fuel tank 1 is fitted with a horizontally extending bearing 10. That portion of the bearing 10 which faces the lamp wick holder 6 is engaged with a cylindrical roller 15, into which a rotatable operation shaft 11 is inserted. The front end of that portion of the operation shaft 11 which faces the lamp wick holder 6 is fitted with a pinion 12. The other end of the operation shaft 11 is fitted with an operation knob 13. An inclined rack 9 is fitted to the outer peripheral wall of the lamp wick holder 6 in a state engaged with the pinion 12. A guide member 14 which is disposed at the outside of the rack 9 is fitted to the outer wall of the lamp wick holder 6. The guide member 14 rolls on the roller 15 and has its movement so defined as to cause the lamp wick holder 6 to move vertically in concentric relationship with the lamp wick guide 3. The rotation of the operation knob 13 leads to the rotation of the pinion 12, and consequently the vertical movement of the rack 9 engaged with said pinion 12. When, therefore, the operation knob 13 is rotated, the lamp wick holder 6 is vertically moved in concentric relationship with the lamp wick guide 3.

Figure 2:
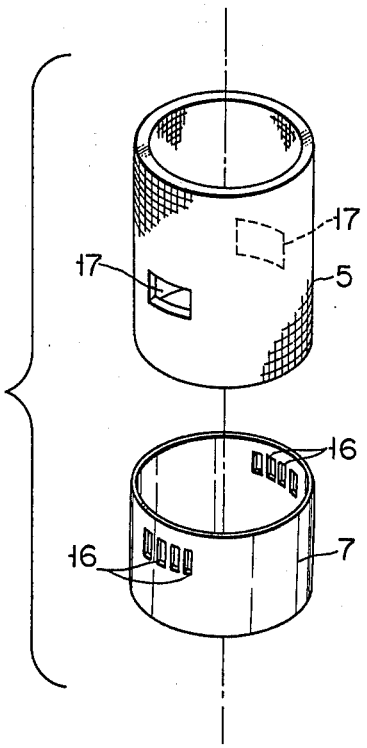
FIG. 2 is an oblique view of a lamp wick and auxiliary lamp wick holder disengaged from each other.
Figure 3:
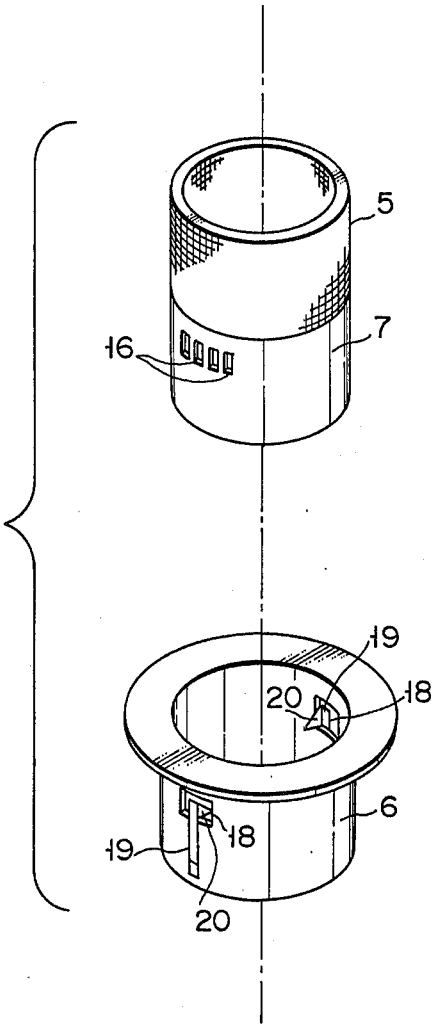
FIG. 3 is an oblique view of a lamp wick around which the auxiliary lamp wick holder is fitted and a dismembered lamp wick holder.

Detailed description is now given of the lamp wick equipment. FIG. 2 is an oblique view of the lamp wick 5 and auxiliary lamp wick holder 7. FIG. 3 is an oblique view of the lamp wick 5, lamp wick holder 6 and auxiliary lamp wick holder 7. A pair of rectangular openings 17 are cut out at a proper point on the lower portion of the peripheral wall of the lamp wick 5 in a state diametrically facing each other. The auxiliary lamp wick holder 7 is constructed by shaping a thin metal plate in the cylindrical form and surrounds the lower portion of the lamp wick 5. The holding pawls 8 (FIG. 1) mounted on the inner peripheral wall of the auxiliary lamp wick holder 7 cause the lamp wick 5 to be securely engaged with the auxiliary lamp wick holder 7. Those portions of the peripheral wall of the auxiliary lamp wick holder 7 which face the paired openings 17 are respectively drilled with a plurality of (for example, four as indicated in FIG. 2) engagement slits 16 extending vertically of said auxiliary lamp wick holder 7. The lamp wick holder 6 is a cylindrical member flanged at the upper end and is fitted around the auxiliary lamp wick holder 7. Those portions of the peripheral wall of the lamp wick holder 6 which face the paired groups of the engagement slits 16 are respectively provided with a rectangular engagement window 18. Reference numeral 19 is an elastic band-shaped strip extending vertically of the lamp wick holder 6. The upper end of said elastic band-shaped plate 19 is fitted with an engagement pawl 20. This pawl 20 projects from the engagement window 18 into the lamp wick holder 6. The lower end of said elastic plate 19 is fixed to the outer peripheral wall of the lamp wick holder 6. The elastic engagement band-shaped plate 19 normally urges the engagement pawl 20 forward the inside of the lamp wick holder 6. Where, however, requires, the engagement pawl 20 can be retracted out of the engagement window 18 against the elastic force of the elastic band-shaped plate 19.

Figure 4A:
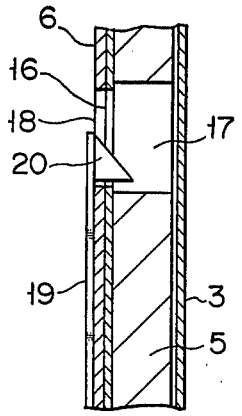
FIGS. 4A and 4B are sectional views of the lamp wick, auxiliary lamp wick holder and lamp wick holder engaged together by means of the engagement pawl.

As illustrated in FIG. 3, the lamp wick 5 engaged with the auxiliary lamp wick holder 7 is inserted into the lamp wick holder 6 for engagement between the auxiliary lamp wick holder 7 and lamp wick holder 6. The engagement window 18, engagement slits 16 and rectangular opening 17 are aligned, then, the engagement pawl 20 penetrates the engagement window 18 and any of the plural engagement slits 16, and projects into the rectangular opening 17 of the lamp wick 5 (FIG. 4A). At this time, the engagement pawl 20 is engaged with the rectangular opening 17 of the lamp wick 5 and any of the engagement slits 16 of the auxiliary lamp wick holder 7, thereby suppressing the relative movement of the lamp wick holder 6 and lamp wick 5.

Figure 5:
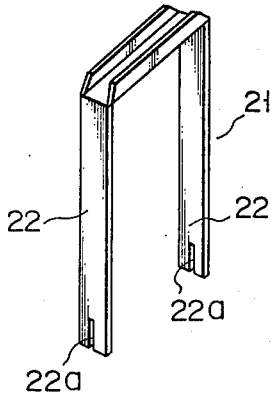
FIG. 5 is an oblique view of a lamp wick-removing device.

FIG. 5 is an oblique view of a lamp wick removing device 21. This device 21 comprises a pair of long leg members 22. The leg members 22 are spaced from each other at a distance corresponding to the diameter of the outer peripheral wall of the auxiliary lamp wick holder 7. Each leg 22 is curved crosswise to an extent conformity with the outline of the outer peripheral wall of the auxiliary lamp wick holder 7. A groove **22*a* extending lengthwise of the leg 22** is cut out from its lower end.

Figure 4B:
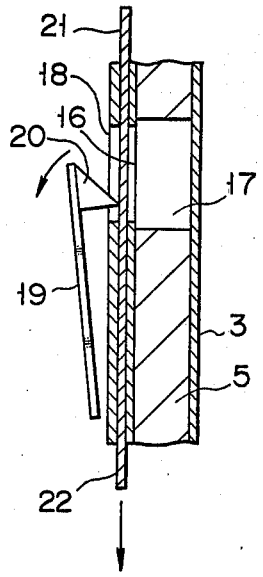
Figure 6:
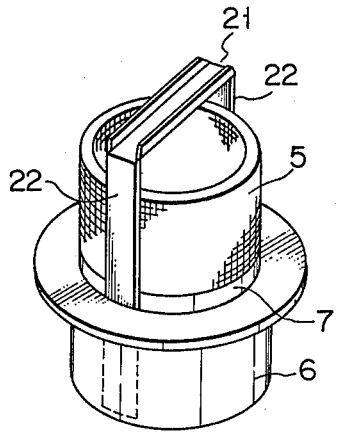
FIG. 6 is an oblique view of a process of taking off a lamp wick by means of the lamp wick-removing device.

Description is now made of the operation of a lamp wick equipment embodying this invention. When combustion is started, the operation knob 13 is actuated to rotate the operation shaft 11 and pinion 12, causing the rack 9 threadedly engaged with the pinion 12 to move upward. As a result, the lamp wick holder 6 and lamp wick 5 engaged therewith are jointly lifted, thereby causing the upper end of the lamp wick 5 to project into the chafing dish member 23. The upper end portion of the lamp wick 5 is ignited by a proper igniting mechanism, with the cylindrical combustion unit 24 kept in a lifted position. The lower end portion of the lamp wick 5 is dipped in the fuel **1*a* held in the oil storing groove 4. The fuel 1*a* is sucked upward through the lamp wick 5 to be continuously supplied to the ignited section of the lamp wick 5**, thereby allowing for the sustenance of combustion.

Where foreign matter is carried into the fuel **1*a* or is denatured, then impurities such as tarry substances are deposited on the lamp wick 5, resulting in unsatisfactory combustion. At the occurrence of such event, the used lamp wick 5 is replaced by a fresh one through the following steps. First, the cylindrical combustion unit 24 is taken off the chafing dish member 23. The paired legs 22 of the lamp wick-removing device 21 are let pass from the chafing dish member 23 downward the inner peripheral wall of the guide cylinder 25. As a result, the paired legs 22 are brought into between the lamp wick holder 6 and auxiliary lamp wick holder 7. FIG. 4B is a sectional view showing the paired legs 22 of the lamp wick-removing device 21 inserted into between the lamp wick holder 6 and the auxiliary lamp wick holder 7. FIG. 6 is an oblique view of the members shown in FIG. 4B. When the legs 22 of the lamp wick-removing device 21 are inserted, the engagement pawl 20 engaged with the engagement window 18, any of the engagement slits 16 and the rectangular opening 17 is retracted out of the lamp wick holder 6 against the elastic force of the engagement strip 19. As a result, the paired engagement pawls 20 are disengaged from the engagement slits 16 of the auxiliary lamp wick holder 7, and the paired rectangular openings 17 of the lamp wick 5, thereby allowing for the movement of the lamp wick 5 and auxiliary lamp wick holder 7 relative to the lamp wick holder 6. When, under this condition, the lamp wick-removing device 21 is lifted, with the lamp wick 5 damped between the paired legs 22, or the lamp wick 5 is pulled upward with its upper end gripped by the fingers, then the lamp wick 5 can be taken off the lamp wick holder 6**.

Figure 7:
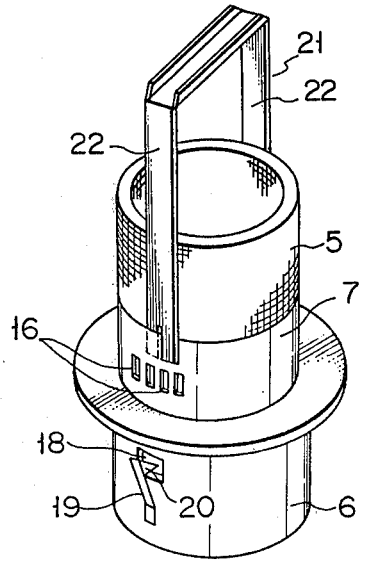
FIG. 7 is an oblique view of a process of inserting a lamp wick by means of said removing device.

Thereafter, as shown in FIG. 7, a fresh lamp wick 5 is fitted into the auxiliary lamp wick holder 7 in such a manner that the rectangular opening 17 of the lamp wick 5 and any of the engagement slits 16 of the auxiliary lamp wick holder 7 are aligned with each other. The paired support grooves 22*a* of the lamp wick-removing device 21 are made to engage with the upper edge of the auxiliary lamp wick holder 7. The lamp wick 5 and auxiliary lamp wick holder 7 are supported by the lamp wick-removing device 21 in a state clamped by the paired legs 22. Or, while the upper edge of the lamp wick 5 is gripped by the fingers, the lamp wick 5 and auxiliary lamp wick holder 7 are let pass through the guide cylinder 25 from the chafing dish member 23 into the lamp wick holder 6. When the engagement window 18 of the lamp wick holder 6, any of the engagement slits 16 of the auxiliary lamp wick holder 7 and the rectangular opening 17 of the lamp wick 5 are aligned with each other, then the engagement pawl 20 of the engagement strip 19 projects into any of the engagement slits 16 and the rectangular opening 17 to effect their mutual engagement. As a result, the lamp wick holder 6 and lamp wick 5 are coupled together. The actuation of the operation knob 13 allows for the vertical movement of the lamp wick holder 6 and lamp wick 5, thereby allowing for the ignition or extinction of the combustion device.

If, for example, the chafing dish member 23 is provided with marks facing the paired engagement windows 18, then said engagement windows 18, any of the engagement slits 16 and the paired rectangular openings 17 of the lamp wick 5 can be aligned with each other easily and quickly. These marks can be conveniently used for alignment of the paired legs 22 of the lamp wick-removing device 21 with any of the engagement slits 16 when said legs 22 are inserted into between the lamp wick holder and auxiliary lamp wick holder 7. It sometimes happens during the long use of a combustion apparatus that moisture separated from a fuel 1*a* such as kerosene gradually settles on the lower end portion of the lamp wick 5, thereby obstructing the suction of the fuel 1*a* through the lamp wick 5. In such event, the lamp wick 5 can be easily stripped of settled moisture by removing the lamp wick 5 from the lamp wick holder 6 through the aforesaid steps. With the foregoing embodiment, the lamp wick 5 and lamp wick holder 6 were jointly moved vertically by engagement between the rack 9 fitted to the lamp wick holder 6 and the pinion 12 mounted on the operation shaft 11. However, this invention is not limited to such arrangement, but the vertical movement of the lamp wick 5 may be effected by applying a lever or link.

Figure 8:
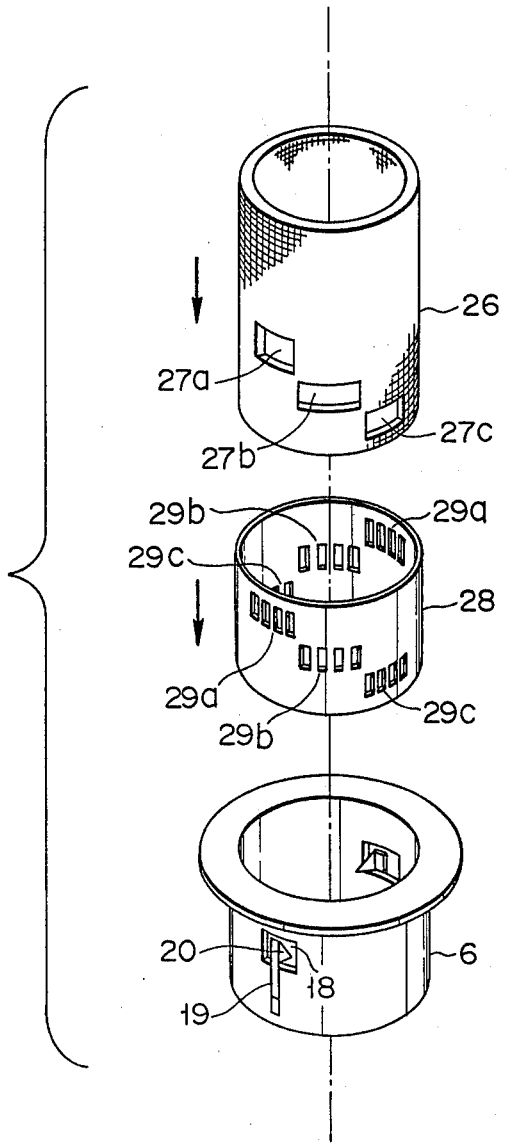
FIG. 8 is an oblique view of a lamp wick equipment according to a second embodiment of this invention.

Description is now given with reference to FIG. 8 of a lamp wick equipment according to a second embodiment of this invention. This second embodiment enables the lamp wick to be selectively set at any of different heights. FIG. 8 is an oblique view of a lamp wick 26, auxiliary lamp wick holder 28 and lamp wick holder 6 included in a lamp wick equipment according to the second embodiment of the invention. The lamp wick 26 has a cylindrical shape like the lamp wick 5 of the first embodiment. Three pairs 27*a*, 27*b*, 27*c* of rectangular openings respectively diametrically facing each other are cut out in the lower half portion of the peripheral wall of the lamp wick 26. Said pairs 27*a*, 27*b*, 27*c* are displaced from each other circumferentially as well as vertically of the lamp wick 26. The auxiliary lamp wick holder 28 is cylindrically shaped like the auxiliary lamp wick holder 7 of the first embodiment, and surrounds the lower portion of the lamp wick 26. The lamp wick 26 and auxiliary lamp wick holder 28 are secured to each other by holding pawls (not shown) mounted on the inner wall of the auxiliary lamp wick holder 28. Those portions of the peripheral wall of the auxiliary lamp wick holder 28 which face three rectangular openings 27*a*, 27*b*, 27*c* arranged in one side of the peripheral wall of the cylindrical lamp wick 26 are respectively drilled with three groups 29*a*, 29*b*, 29*c* each consisting of four vertically extending engagement slits. The same groups 29*a*, 29*b*, 29*c* of the vertically extending engagement slits are formed on the opposite side of the auxiliary lamp wick holder 28. The lamp wick 26 and auxiliary lamp wick holder 28 are securely engaged with each other in such a manner that the rectangular openings 27*a*, 27*b*, 27*c* of the lamp wick 26 are respectively aligned with the three groups 29*a*, 29*b*, 29*c* each consisting of four vertically extending engagement slits. When the engaged lamp wick 26 and auxiliary lamp wick holder 28 are inserted at the bottom into the lamp wick holder 6 in such a manner that the group 29*a* of four vertically extending engagement slits which is provided in the peripheral wall of the auxiliary lamp wick holder 28 is aligned with the engagement window 18 of the lamp wick holder 6, then the engagement pawl 20 mounted on the upper end of the engagement strip 19 is introduced into any of the four vertically extending engagement slits constituting the group 29*a* to project into the rectangular opening 27*a* of the lamp wick 26, thereby effecting communication between the rectangular opening 27*a* and the group 29*a* of four vertically extending engagement slits to prevent the relative movement of the lamp wick holder 6 and lamp wick 26. When the auxiliary lamp wick holder 28 is inserted into the lamp wick holder 6, then the engagement pawl 20 is engaged with the rectangular opening 27*b* of the lamp wick 26 and any of the four vertically extending engagement slits constituting the group 29*b*. When the auxiliary lamp wick holder 28 is inserted into the lamp wick holder 6 for alignment between the engagement window 18 of said lamp wick holder 6 and any of the four vertically extending engagement slits constituting the group 29*c*, then the engagement pawl 20 is engaged with the rectangular opening 27*c* of the lamp wick 26 and any of the four vertically extending engagement slits constituting the group 29*c*, thereby effecting engagement between the lamp wick holder 6 and lamp wick 26.

Figure 9A:
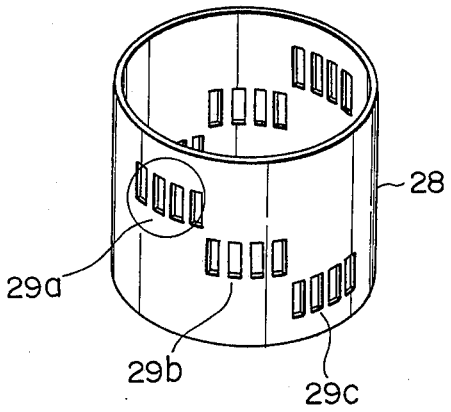
FIGS. 9A, 9B, 10A, 10B and 11A, 11B are schematic illustrations showing the operation of lamp wick equipments according to other embodiments.
Figure 9B:
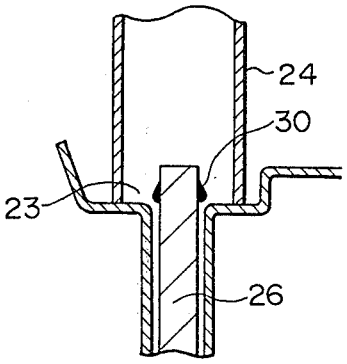
Figure 10A:
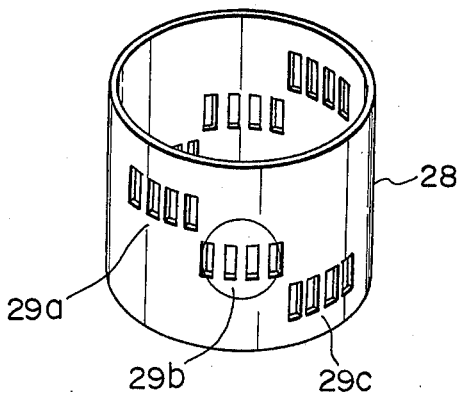
Figure 10B:
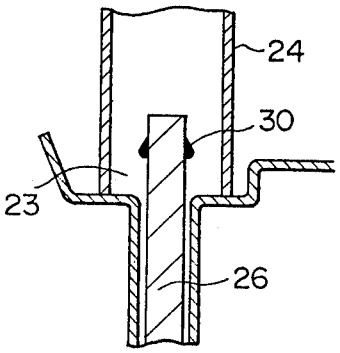
Figure 11A:
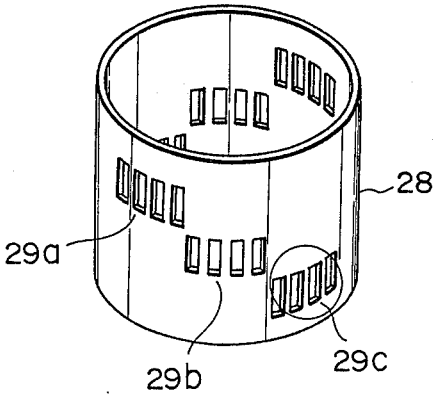
Figure 11B:
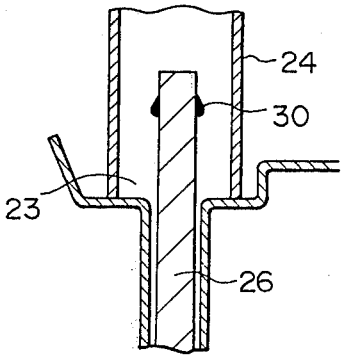

With the foregoing second embodiment the lamp wick 26 is first inserted into the lamp wick holder 6 for alignment throughout any of the four vertically extending engagement slits constituting the group 29*a* of the auxiliary lamp wick holder 28, the rectangular opening 27*a* of the lamp wick 26 and the engagement window 18 of the lamp wick holder 6. As a result, the engagement pawl 20 is engaged with any of the four vertically extending slits constituting the group 29*a* of the auxiliary lamp wick 28 and the rectangular opening 27*a* of the lamp wick 26 as shown by a circle given in FIG. 9A. As a result, the lamp wick 26 is securely set in the lamp wick holder 6. If denatured kerosene, or kerosene contaminated by foreign matter is used as a fuel, then tarry substances 30 are deposited on that portion of the upper end of the lamp wick 26 which is exposed to the interior of the chafing dish member 23 as seen from FIG. 9B. The conventional process of removing the tarry substances 30 comprises evacuating the fuel tank 1 and igniting the lamp wick 26. When, however, the tarry substances 30 settle on the lower end region of that portion of the lamp 26 which is exposed to the interior of the chafing dish member 23, then it is impossible to take off the tarry substances 30, because said lower end region is not sufficiently heated for the removal of the tarry substances 30. In such a case, the lamp wick 26 is taken off the lamp wick holder 6 by means of the lamp wick-removing device 21 as previous described. Thereafter, the lamp wick 26 is again inserted into the lamp wick holder 6 for alignment throughout any of the four vertically extending engagement slits constituting the group 29*b*, the rectangular opening 27*b* of the lamp wick 26 and the engagement window 18 of the lamp wick holder 6. At this time the engagement pawl 20 is engaged with any of the four vertically extending engagement slits constituting the group 29*b* as seen from a circle given in FIG. 10A. Since, at this time, the lamp wick 26 occupies a higher position, tarry substances 30 tend to settle on the upper region of that portion of the lamp wick 26 which is exposed to the interior of the chafing dish member 23. When, therefore, the aforesaid ignition process for removal of deposited tarry substances with the fuel tank emptied sufficiently heats the deposition-contaminated region of the lamp wick 26, the tarry substances 30 can be easily taken off. When impurities deposited in the lamp wick 26 cannot be cleaned even by the above-mentioned process, it is advised to insert the lamp wick 26 again into the lamp wick holder 6 for engagement of the engagement pawl 20 with any of the vertically extending engagement slits constituting the group 29*c* and the rectangular opening 27*c* formed on the peripheral wall of the lamp wick 26. This operation causes the lamp wick 26 to assume a higher position, and consequently the idle ignition process with the fuel tank emptied enables the the deposited tarry substances 30 to be reliably removed, thereby assuring the longer effective life of the lamp wick 26. The easy removal of the lamp wick 26 by the lamp wick-removing device 21 facilitates the re-insertion of the cleaned lamp wick 26 into the lamp wick holder 6.

Figure 12:
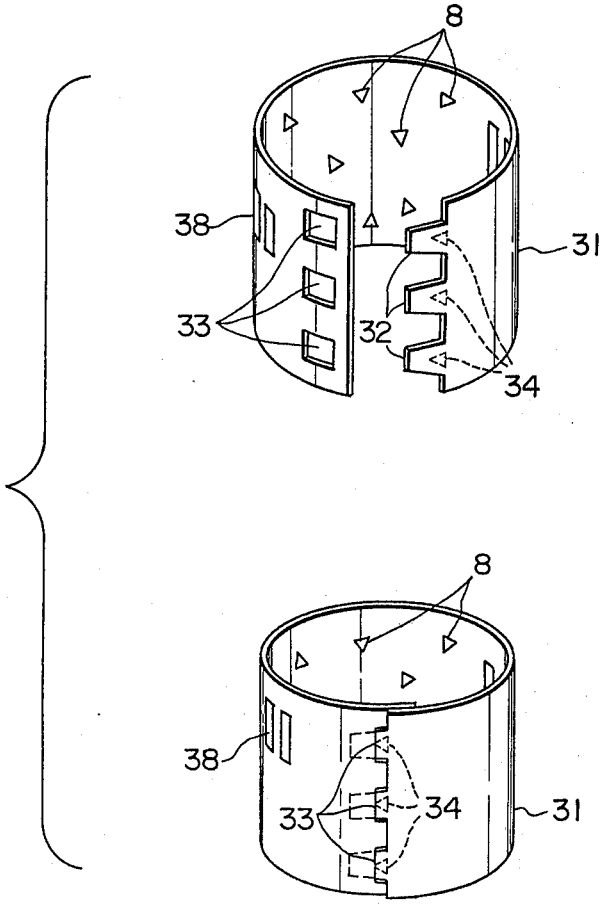
FIG. 12 is an oblique view of a modification of an auxiliary lamp wick holder used with the lamp wick equipment of the invention.

Description is now given with reference to FIG. 12 of a lamp wick equipment modified from the preceding embodiment. With the modification of FIG. 12, the auxiliary lamp wick holder 31 is the type which can be easily assembled and allows for the easy packing, transportation and care or keeping. FIG. 12 is an oblique view of the auxiliary lamp wick holder 31, showing the manner in which said lamp wick holder 31 is assembled. The auxiliary lamp wick holder 31 is constructed by lengthwise bending a band-shaped plate into a cylindrical form. Said band-shaped plate is provided at the end with a plurality of insertion pawls 32 and at the other end with a plurality of holder 33 allowing for the insertion of said insertion pawls 32. A stationary pawl 34 is mounted on the inner wall of each insertion pawl 32. The cylindrical auxiliary lamp wick holder 31 is constructed by inserting the insertion pawls 32 into the corresponding holes 33 in such a manner that the stationary pawl 34 is engaged with the edge of each engagement hole 33. As a result, the mutually facing edges of the band-shaped metal plate are joined together, to provide the cylindrical auxiliary lamp wick holder 31. The auxiliary lamp wick holder 31 has the same diameter and dimensions as the aforesaid auxiliary lamp wick holder 7 (FIG. 2) and auxiliary lamp wick holder 28 (FIG. 8). The groups each considering of the same number of vertically extending engagement slits 38 are cut out in the same predetermined positions as in the preceding embodiments.

Figure 13:
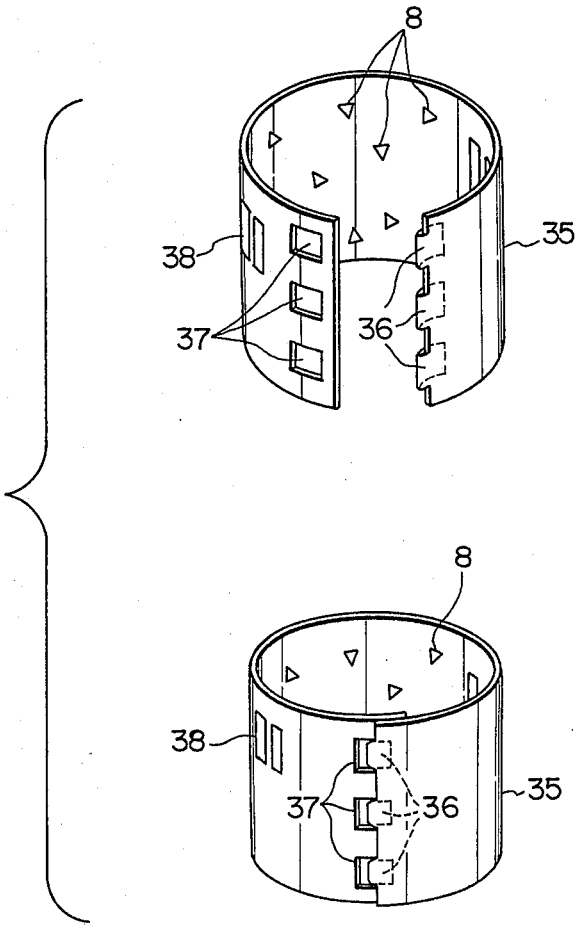
FIG. 13 is an oblique view of another modification of an auxiliary lamp wick holder.

Description is now given with reference to FIG. 13 of a lamp wick equipment modified from the preceding embodiment. FIG. 13 is an oblique view of an auxiliary lamp wick holder 35, showing the manner in which said holder 35 is assembled. Like the auxiliary lamp wick holder 31 of the preceding modification, the auxiliary lamp wick holder 35 of FIG. 31 is constructed by bending a band-shaped plate into the cylindrical form. One of the mutually facing edges of said band-shaped plate is provided with a plurality of key-shaped catch pawls 36. The opposite edge of said band-shaped plate is provided with a plurality of catch holes 37 engageable with said catch pawls 36. The auxiliary lamp wick holder 35 is constructed in the form of a cylinder having the prescribed dimensions by engaging the catch pawls 36 with the corresponding catch holes 37. The holding pawls 8 mounted on the inner peripheral wall of the auxiliary lamp wick holder 31 or 35 are intended, as previously described, to fix the lamp wick 5 or 26.

The auxiliary lamp wick holder 31 (FIG. 12) or 35 (FIG. 13) is constructed into the cylindrical form only when put to use. The auxiliary lamp wick holder 31 or 35 which is the parts of combustion apparatus is stored and shipped in the form of a flat plate. So, the parts can be easily managed and packed, and a large number of the parts can be stored and shipped at a time. As a result, the auxiliary lamp wick holder 31 or 35 can be supplied to the user at a low cost.

What we claim is:

1. A lamp wick equipment for a combustion apparatus which comprises:

a cylindrical lamp wick whose peripheral wall is provided with at least one opening;

a cylindrical auxiliary lamp wick holder which is fitted around the lamp wick and comprises an engagement hole formed at that spot on the peripheral wall of said auxiliary lamp wick holder which faces said opening of the lamp wick;

a lamp wick holder which comprises a cylindrical body fitted around the auxiliary lamp wick holder, and an engagement pawl which is so elastically supported as to be normally advanced into the inside of said cylindrical body, to be retractable therefrom, and to project into the engagement hole of the auxiliary lamp wick holder fitted into said cylindrical body to effect engagement between the lamp wick and lamp wick holder; and a lamp wick-removing device comprising at least one leg member which is inserted between the auxiliary lamp wick holder and the lamp wick holder to retract the engagement pawl from the engagement hole, thereby disengaging the lamp wick from the lamp wick holder.

2. The lamp wick equipment according to claim 1, wherein the lamp wick comprises a pair of openings formed in the peripheral wall in a state diametrically facing each other.

3. The lamp wick equipment according to claim 1, wherein the engagement hole comprises a plurality of parallel vertically extending slits which are arranged in the circumferential direction of the auxiliary lamp wick holder.

4. The lamp wick equipment according to claim 1, wherein the lamp wick holder comprises a pair of engagement windows formed on the opposite sides of the peripheral wall; and each engagement pawl is so elastically supported as to project into the lamp wick holder through the engagement window.

5. The lamp wick equipment according to claim 4, wherein the engagement pawl is fitted to one end of a band-shaped plate, the other end of which is fixed to the outer peripheral wall of the lamp wick holder, and is normally urged by the elastic force of the band-shaped plate toward the inside of the lamp wick holder.

6. The lamp wick equipment according to claim 1, wherein a plurality of holding pawls are formed on the inner peripheral wall of the auxiliary lamp wick holder, and said holding pawls are made to cut into the outer peripheral wall of the lamp wick fitted into the auxiliary lamp wick holder, thereby assuring tight engagement between the lamp wick and auxiliary lamp wick holder.

7. The lamp wick equipment according to claim 1, wherein the lamp wick-removing device comprises a pair of long plate-shaped legs spaced from each other at a distance corresponding to the diameter of the outer peripheral wall of the auxiliary lamp wick holder.

8. The lamp wick equipment according to claim 7, wherein said legs are each provided with a slit lengthwise extending from the free end.

* * * * *